US008723427B2

(12) United States Patent
Collins et al.

(10) Patent No.: US 8,723,427 B2
(45) Date of Patent: May 13, 2014

(54) SYSTEMS AND METHODS FOR LED CONTROL USING ON-BOARD INTELLIGENCE

(75) Inventors: Patrick Collins, Conyers, GA (US); Antonio Marques, Covington, GA (US); James Clarence Johnson, Conyers, GA (US)

(73) Assignee: ABL IP Holding LLC, Conyers, GA (US)

( * ) Notice: Subject to any disclaimer, the term of this patent is extended or adjusted under 35 U.S.C. 154(b) by 126 days.

(21) Appl. No.: 13/439,975

(22) Filed: Apr. 5, 2012

(65) Prior Publication Data

US 2012/0256548 A1 Oct. 11, 2012

Related U.S. Application Data

(60) Provisional application No. 61/472,015, filed on Apr. 5, 2011.

(51) Int. Cl.
*H05B 37/02* (2006.01)

(52) U.S. Cl.
USPC ..... 315/151; 315/297; 315/152; 315/192

(58) Field of Classification Search
None
See application file for complete search history.

(56) References Cited

U.S. PATENT DOCUMENTS 5,089,751 A 2/1992 Wong et al.
5,381,296 A 1/1995 Ekelund et al.
5,998,929 A * 12/1999 Bechtel et al. ..... 315/82
6,153,985 A 11/2000 Grossman
6,414,437 B1 7/2002 Diez et al.
6,590,343 B2 7/2003 Pederson
6,693,394 B1 2/2004 Guo et al.
6,773,154 B2 8/2004 Desai
6,786,625 B2 9/2004 Wesson
6,798,152 B2 9/2004 Rooke et al.
6,803,732 B2 10/2004 Kraus et al.
6,844,681 B2 1/2005 Serizawa et al.
6,932,498 B2 8/2005 Miyazaki
6,963,175 B2 11/2005 Archenhold
7,040,790 B2 5/2006 Lodhie et al.
7,042,165 B2 5/2006 Madhani et al.
7,064,498 B2 6/2006 Dowling et al.
7,075,423 B2 7/2006 Currie
7,119,498 B2 10/2006 Baldwin et al.
7,132,805 B2 11/2006 Young
7,183,727 B2 2/2007 Ferguson et al.
7,239,093 B2 7/2007 Hsieh
7,248,002 B2 7/2007 Yamamoto et al.
7,274,150 B2 9/2007 Takeda et al.
7,294,968 B2 11/2007 Ito et al.
7,345,433 B2 3/2008 Bacon et al.
7,360,924 B2 4/2008 Henson et al.
7,441,928 B2 10/2008 Futami (Continued)

*Primary Examiner* — Crystal L Hammond
(74) *Attorney, Agent, or Firm* — Kilpatrick Townsend & Stockton, LLP

(57) ABSTRACT

Board level conditions associated with the operation of multiple LEDs are sensed and used to control a driver that powers the LEDs. The driver is controlled via a 0-10V control interface. The board-level conditions include, but are not limited to, temperature, ambient light, light intensity, operating time, time of day, current, and voltage. An on-board intelligent (OBI) controller processes the 0-10V control signal before it is provided to the driver to better control the LEDs. In some systems the OBI controller works in conjunction with a separate 0-10V controller that controls one or more luminaires.

13 Claims, 8 Drawing Sheets

(56) References Cited

U.S. PATENT DOCUMENTS

| | | | | |
|---|---|---|---|---|
| 7,507,001 | B2 | 3/2009 | Kit | |
| 7,557,524 | B2 | 7/2009 | Chevalier et al. | |
| 7,573,210 | B2 | 8/2009 | Ashdown et al. | |
| 7,598,685 | B1 | 10/2009 | Shteynberg et al. | |
| 7,635,957 | B2 | 12/2009 | Tripathi et al. | |
| 7,688,002 | B2 | 3/2010 | Ashdown et al. | |
| 7,714,515 | B2 | 5/2010 | Emek et al. | |
| 7,804,256 | B2 | 9/2010 | Melanson | |
| 7,825,599 | B2 | 11/2010 | Yagi et al. | |
| 7,847,486 | B2 | 12/2010 | Ng | |
| 7,863,829 | B2 | 1/2011 | Sayers et al. | |
| 8,456,092 | B2 * | 6/2013 | Knapp | 315/152 |
| 2002/0043943 | A1 | 4/2002 | Menzer et al. | |
| 2003/0122494 | A1 * | 7/2003 | Ide | 315/169.3 |
| 2005/0082989 | A1 | 4/2005 | Jones et al. | |
| 2006/0118775 | A1 | 6/2006 | Nagai et al. | |
| 2006/0274540 | A1 | 12/2006 | Klaver et al. | |
| 2008/0136350 | A1 | 6/2008 | Tripathi et al. | |
| 2009/0021181 | A1 | 1/2009 | Brune et al. | |
| 2009/0085503 | A1 | 4/2009 | Narita et al. | |
| 2009/0195168 | A1 | 8/2009 | Greenfeld | |
| 2010/0013409 | A1 | 1/2010 | Quek et al. | |
| 2010/0109575 | A1 | 5/2010 | Ansems et al. | |
| 2010/0148691 | A1 | 6/2010 | Kuo et al. | |
| 2010/0171442 | A1 | 7/2010 | Draper et al. | |
| 2010/0259182 | A1 | 10/2010 | Man et al. | |
| 2010/0277077 | A1 | 11/2010 | Pong et al. | |
| 2010/0327756 | A1 | 12/2010 | Ellman et al. | |
| 2010/0327770 | A1 | 12/2010 | Pados et al. | |
| 2011/0001432 | A1 | 1/2011 | Chung et al. | |

* cited by examiner

SYSTEMS AND METHODS FOR LED CONTROL USING ON-BOARD INTELLIGENCE

RELATED APPLICATION

This application claims priority to U.S. Ser. No. 61/472,015 entitled Systems and Method for LED Control Using On-Board Intelligence filed Apr. 5, 2011, which is incorporated herein by reference.

FIELD OF THE INVENTION

The present invention is directed to controlling LED luminaires using a driver with 0-10V control and on-board intelligence.

BACKGROUND

Currently available LED drivers and controllers include those that support a 0-10V control interface. These drivers and controllers are commonly used for dimming. FIG. 1 illustrates one example of a system using 0-10V control and includes a 0-10V controller or switch (e.g., a dimmer) 102, a driver 104, and an LED board 106. The driver provides a 0-10V control interface 108, which is a current limited voltage source. FIG. 1 illustrates the 0-10V control interface as providing a power signal to the controller (0-10 Control Power Signal) and receiving a 0-10V control signal (0-10 Control Regulated Signal) from the controller. The driver powers the LED board at a level that is based on the 0-10V control signal. For example, when the 0-10V control signal is 10V, then the driver powers the LED board so that it provides full light output. When the 0-10V control signal is 5V, then the driver powers the LED board so that it provides 50% light output.

Some systems include additional sensors or controls that may modify the 0-10V control signal provided to the driver (not shown). For example, an ambient light sensor may sense ambient light and based on the amount of sensed ambient light may increase or decrease the voltage on the 0-10V control signal so that the voltage seen by the driver is different than the voltage sent from the controller. Typically these sensors sense conditions at the system level and do not adequately account for conditions on the LED board or for differences between the LED boards.

Although FIG. 1 illustrates that the controller controls a single driver, which powers a single LED board, one controller can control multiple drivers and LED boards. If so, then the controller is connected to a second driver in a manner similar to that shown for the first driver and the second driver powers the second LED board. There can also be additional sensors or controls associated with the second driver similar to those described above for the first driver.

SUMMARY

Aspects of the invention provide board level control by sensing conditions related to the operation of the LEDs on the board and using the sensed conditions to control a 0-10V control interface of the LED driver. The sensed conditions include, but are not limited to, temperature, ambient light, light intensity, operating time, time of day, current, and voltage. A controller, referred to herein as an on-board intelligent (OBI) controller, is located on the same board as the LEDs or on a board proximate to the LED board. The OBI controller uses the sensed conditions to determine whether a control signal from an external controller needs to be adjusted. The OBI controller may be implemented using a microprocessor or microcontroller or may be implemented using discrete components. If the external controller controls multiple LED boards, then there can be one OBI controller per LED board. Each OBI controller operates independently of the other OBI controllers to account for different conditions at each LED board or to account for differences between the LED boards.

These and other aspects, features and advantages of the present invention may be more clearly understood and appreciated from a review of the following detailed description and by reference to the appended drawings and claims.

DETAILED DESCRIPTION

In order to provide better control of the LEDs on the LED board, aspects of the present invention sense one or more board-level conditions and use the sensed condition(s) to control the 0-10V control interface of the driver, which in turn adjusts the current (or voltage) provided to the LEDs. The board-level conditions include, but are not limited to, temperature, ambient light, light intensity, operating time, time of day, current, and voltage. An on-board intelligent (OBI) controller processes the 0-10V control signal before it is provided to the driver to better control the LEDs. In some systems the OBI controller works in conjunction with a separate 0-10V controller that controls one or more luminaires. Including an OBI controller as described herein may result in more consistent light output and improved operating life.

Exemplary Operating Environment

Figure 1:
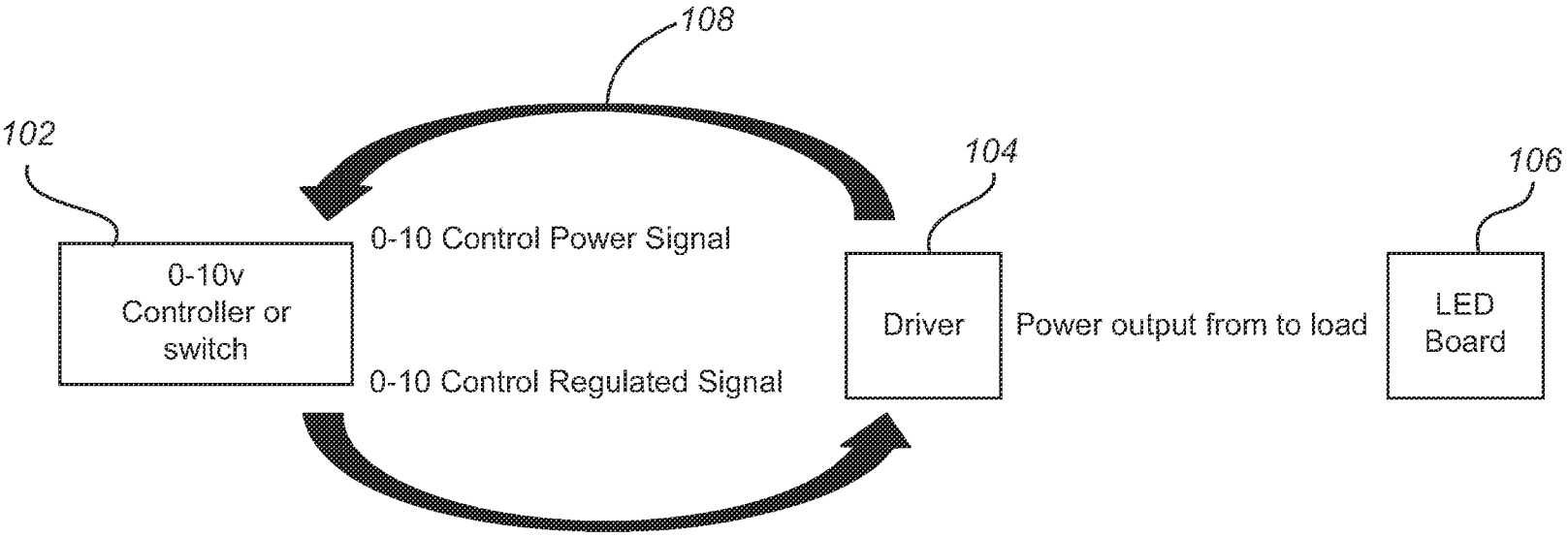
Figure 1 (Prior Art)
FIG. 1 is a block diagram illustrating a lighting system using a 0-10V control interface.
Figure 2:
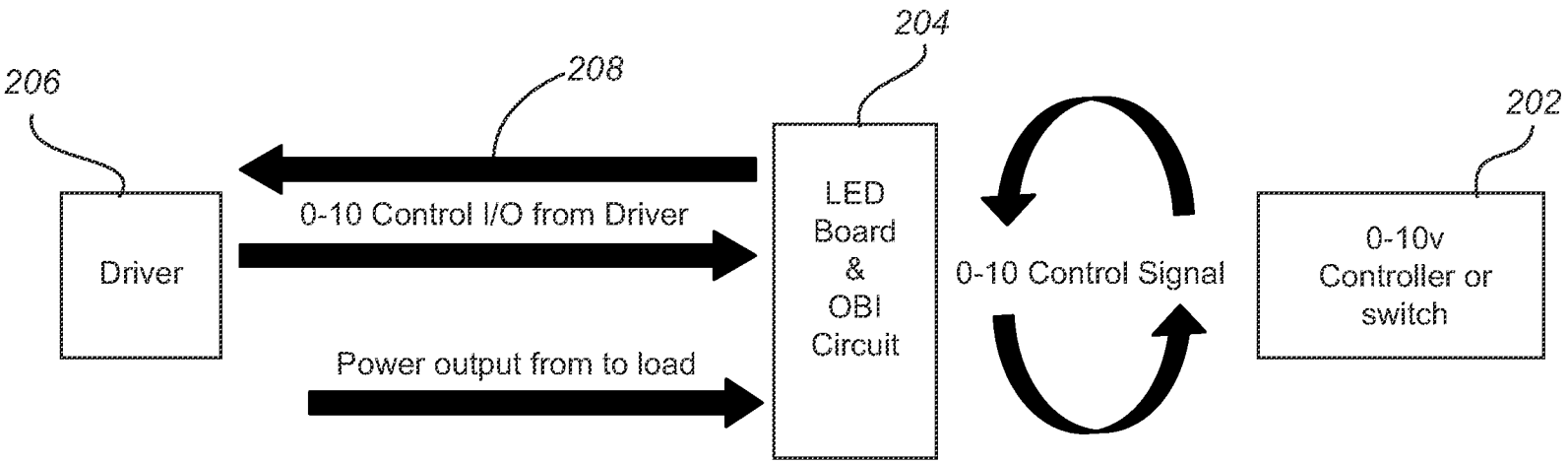
FIG. 2 is a block diagram illustrating an exemplary lighting system using a 0-10V control interface with an on-board intelligent controller.

FIG. 2 illustrates a system for controlling the power provided to an LED board using a controller and on-board intelligence. The system includes a 0-10V controller or switch (e.g., a dimmer) 202, an LED board 204 that includes LEDs and an OBI controller, and a driver 206 with a 0-10V interface 208. The OBI controller includes components and circuitry to sense a condition associated with the LED board and to use the sensed condition to control the 0-10V control interface of the driver.

The controller provides a 0-10V control signal to the OBI controller. If the condition(s) sensed by the OBI controller indicate that there is no need to adjust the 0-10V control signal, then the OBI controller controls the 0-10V control interface of the driver so that it has the same voltage as the signal provided by the controller. However, if the condition(s) sensed by the OBI controller indicate that there is a need to adjust the 0-10V control signal, then the OBI controller adjusts the 0-10V control interface of the driver so that the driver interface has a different voltage than the signal provided by the controller.

In one example, the OBI controller senses temperature. As the temperature increases, the OBI controller decreases the voltage of the 0-10V control interface of the driver to reduce the current (or voltage) provided to the LEDs on the LED board. In this manner, if the temperature of the LEDs is too high, the OBI controller sets the voltage on the 0-10V control interface of the driver to be less than the voltage on the 0-10V control signal provided by the controller to reduce the temperature of the LEDs.

FIG. 2 illustrates that the driver provides a power output signal to the LEDs on the LED board ("Power output from to load" signal). The driver and the OBI controller are connected via the 0-10V control interface of the driver (the "0-10 Control I/O from Driver" signals) 208. The OBI controller adjusts the voltage of the 0-10V control interface of the driver based on the 0-10V control signal the OBI controller receives from the controller ("0-10 Control Signal") and the board-level condition(s) sensed by the OBI controller or provided to the OBI controller. In some implementations, the OBI controller continuously adjusts the 0-10V control interface of the driver based on the board-level conditions, while in other implementations, the OBI controller adjusts the 0-10V control interface for the driver in only certain circumstances.

The OBI controller can include a microcontroller or microprocessor. If so, then the OBI controller can include memory for storing computer-executable code for controlling the 0-10V interface of the driver. Alternatively, the OBI controller can be implemented using discrete components.

Although not shown in FIG. 2, the controller can control multiple luminaires where each luminaire includes an LED Board and OBI controller and a driver. If the controller is connected to additional luminaires, then the elements to the left of the controller in FIG. 2 are replicated for each additional luminaire. In the case where the controller is connected to multiple luminaires, it is possible that the on-board conditions will vary between the luminaires. If so, then it is desirable to adjust the 0-10V control interface only to the LED drivers where the on-board condition indicates that an adjustment is warranted.

The LED board can include jumpers or switches to allow the OBI controller to be disabled or enabled. If the OBI controller is disabled, then the 0-10V controller or switch is connected directly to the 0-10V control interface of the driver.

Exemplary System for Intensity Adjustment

Figure 3:
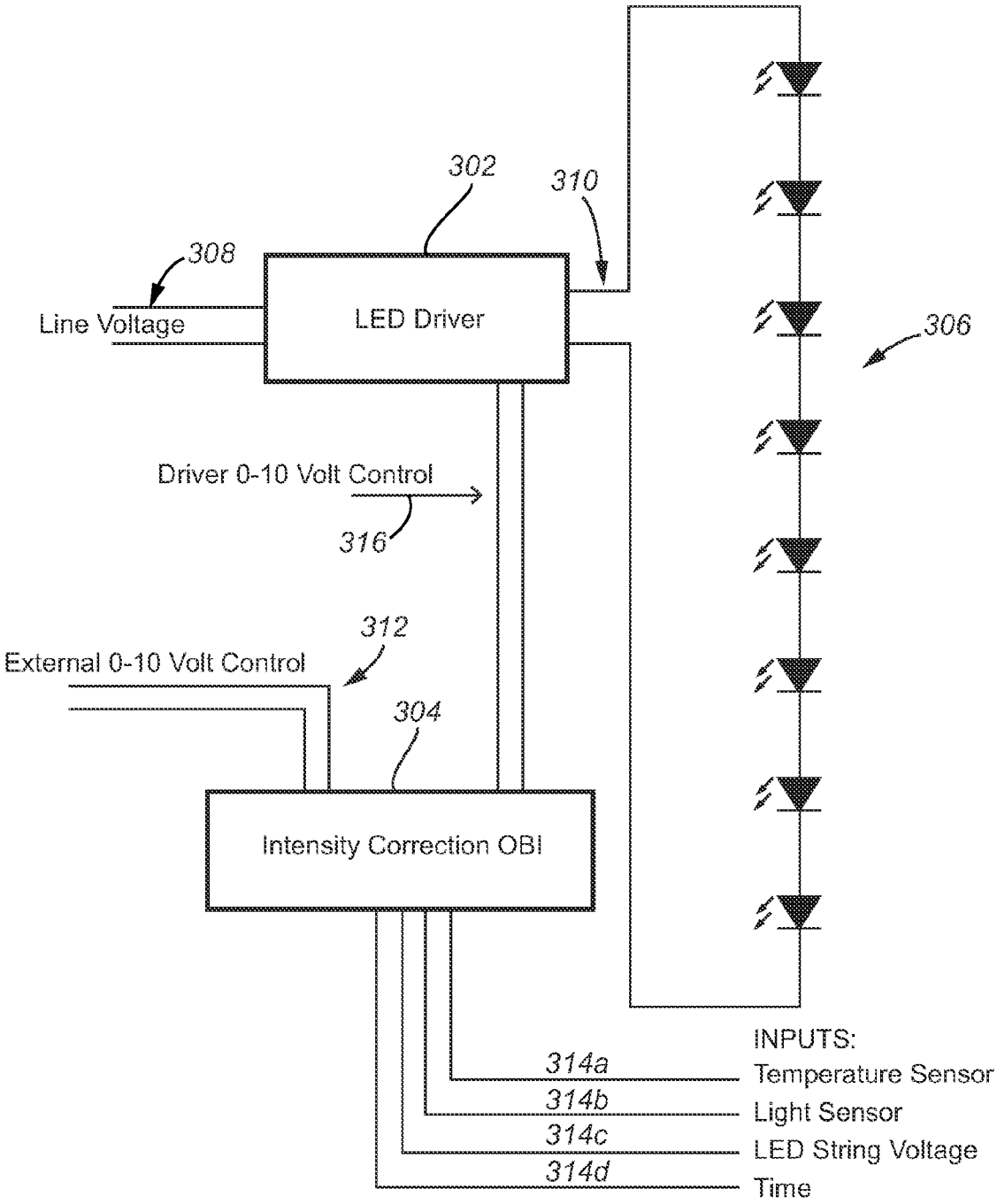
FIG. 3 is a block diagram illustrating an exemplary lighting system using a 0-10V control interface with an on-board intelligent controller.

FIG. 3 illustrates an exemplary system for detecting conditions that affect the light output of the LEDs. The system uses the information about the conditions to control the driver via the 0-10V control interface to adjust the intensity of the LEDs. FIG. 3 illustrates an LED driver 302, an OBI controller 304, and a string of LEDs 306. Although not shown in FIG. 3, the system also may include an external controller, such as a dimmer. The external controller is external to the LED board that includes the LEDs and the OBI controller. The LED driver receives power via its power inputs 308. The power inputs can be connected either directly or indirectly to the line voltage. The driver's power outputs 310 are connected to the string of LEDs.

The OBI controller receives a control signal 312 from the external controller, as well as additional input signals 314*a*, 314*b*, 314*c*, 314*d*, which can include signals from one or more sensors. FIG. 3 illustrates inputs that correspond to temperature 314*a*, light 314*b*, voltage 314*c*, and time 314*d*. Although shown as an input to the OBI controller, in some implementations the inputs can be generated internally by the OBI controller. For example, the OBI controller can determine the time of operation for the LEDs by keeping track of the amount of time that the OBI controller controls the 0-10V control signal to a non-zero level or the OBI controller may include a thermistor. The OBI controller is also connected to the 0-10V control interface of the driver 316.

If the external controller of FIG. 3 is a dimmer, then the amount of dimming indicated by the dimmer is one of the inputs to the OBI controller. For example, if the dimmer provides a signal that is compatible with a 0-10V control interface and the dimmer is set for 50% dimming, then the control signal received by the OBI controller is 5V. The OBI controller can either set the 0-10V control interface of the LED driver to 5V or adjust it to another value. The control signal is adjusted if the inputs or conditions that the OBI controller monitors indicate the need for an adjustment. For example, if the temperature sensor indicates that the LEDs are operating at a temperature that is higher than desired, then the OBI controller may control the 0-10V control interface of the driver to a level that is less than 5 V. Alternatively, if the time sensor indicates that the light output of the LEDs is diminished, perhaps due to aging, then the OBI controller may control the 0-10V control interface of the driver to a level that is higher than 5V.

If the light sensor senses ambient light, then the OBI controller can control the 0-10V control interface to increase the voltage if the sensed ambient light is below a predetermined threshold or range or decrease the voltage if the sensed ambient light is above a predetermined threshold or range.

If the light sensor senses light intensity, then the OBI controller can control the 0-10V control interface so that the driver powers the LEDs to provide a desired intensity. This type of OBI controller can adjust the power provided to the LEDs when a condition, such as temperature, impacts the light output of the LEDs so that the desired light intensity is provided regardless of the conditions.

The OBI controller can also provide part-night control by either providing a sensor that senses dusk and dawn conditions or receiving an input that indicates dusk and dawn conditions. The OBI controller can reduce the voltage on the 0-10V control interface during dusk and dawn conditions.

If one or more LEDs fail, then the LED string voltage (or current) input may indicate an over voltage (or over current) condition. If so, then the OBI controller adjusts the 0-10V control interface to account for the sensed condition.

The OBI controller can provide soft start/power down control. In some existing systems with a dimmer, when the system is powered on, the LEDs are initially powered at 100% and then subsequently adjusted to the level indicated by the dimmer. The OBI controller can control the 0-10V control interface to the driver so that the LEDs are initially powered to the level indicated by the dimmer instead of being initially powered to 100% and then reduced. This eliminates the "overshoot" of existing systems.

Since the light output of the LEDs at a given power level may change as the LEDs age, the OBI controller can monitor the operating time of the LEDs and adjust the 0-10V control interface to the driver to compensate for the aging of the LEDs. For example, after a predetermined number of operating hours, the OBI circuit can increase the voltage on the 0-10V control interface to compensate for the age of the LEDs.

The OBI controller can provide lifetime temperature correction so that the LEDs continue to provide an acceptable light level for a specified lifetime. The OBI circuit monitors the operating hours and temperature of the LEDs and adjusts the 0-10V control interface accordingly.

The OBI controller can provide constant lumen output by adjusting the 0-10V control interface based on the expected performance/lifetime of the LEDs. For example, the OBI controller may adjust the 0-10V interface of the driver to initially power the LEDs at a reduced level and then increase the level as the LEDs age.

Dynamic Dimming

Figure 4:
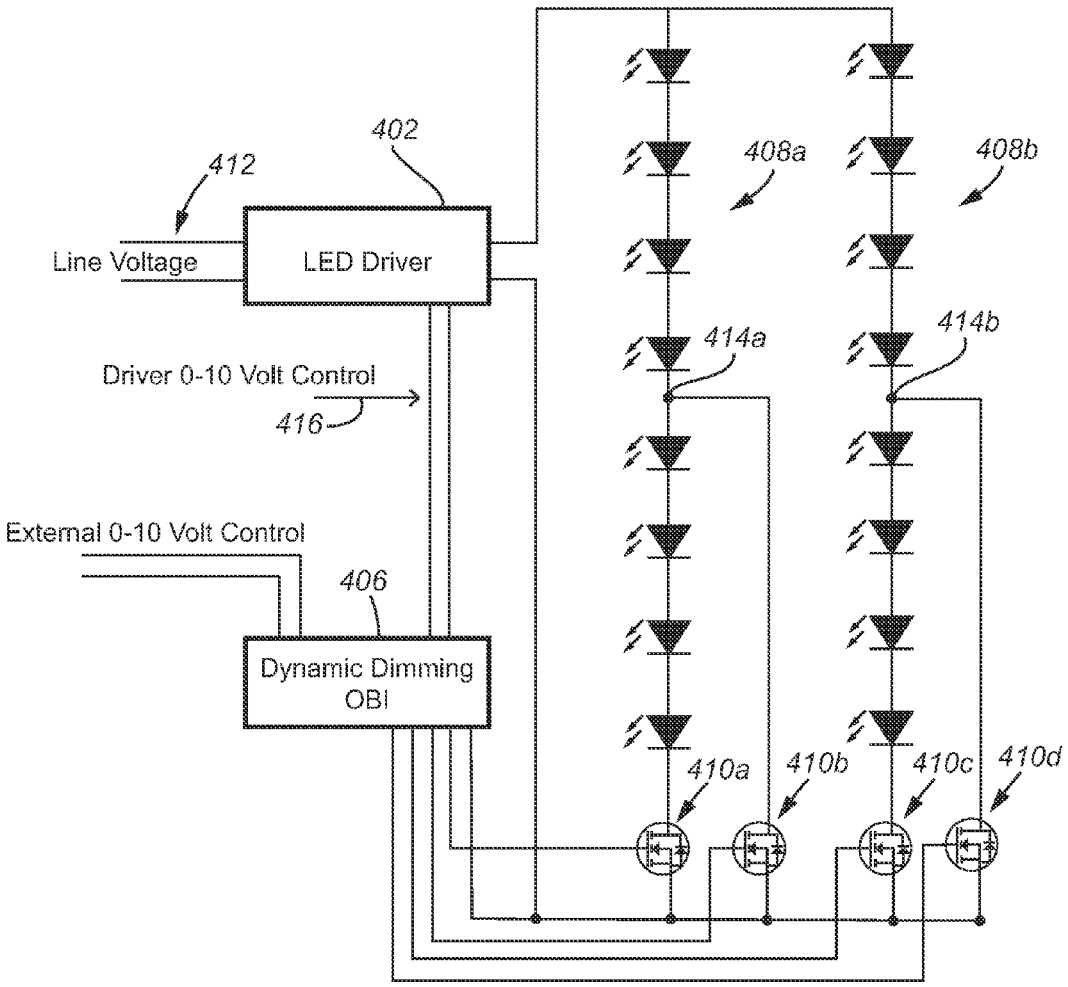
FIG. 4 is a block diagram illustrating an exemplary lighting system using a 0-10V control interface with an on-board intelligent controller.

The OBI controller supports dynamic dimming. In addition to adjusting the 0-10V control interface, the OBI controller can also reconfigure the LEDs to power a different number of LEDs to support different dimming levels. FIG. 4 illustrates an exemplary system that provides dynamic dimming. The system includes an LED driver 402, an OBI controller 406, two strings of LEDs 408*a*, 408*b*, and multiple switches 410*a*, 410*b*, 410*c*, 410*d*. Although not shown in FIG. 4, the system also includes an external controller, such as a dimmer. The LED driver receives power via its power inputs 412. The power inputs can be connected either directly or indirectly to the line voltage. The driver is connected to the LED strings. Each LED string includes a tap point 414*a*, 414*b*. A switch is connected to the tap point 410*b*, 410*d* and another switch is connected to one end of the LED string 410*a*, 410*c*. The tap points and switches allow different numbers of LEDs to be powered at different times.

The OBI controller is connected to the external controller, the 0-10V control interface of the driver 416, and to the switches. Based on the desired dimming indicated on the control signal from the external controller, the OBI controller adjusts the 0-10V control interface, which in turn adjusts the amount of current (or voltage) provided to the LED strings. The OBI controller also adjusts the number of LEDs that are powered by controlling the switches. Using FIG. 4 as an example, there are two strings with eight LEDs in each string. The tap points divide the LEDs between the fourth and fifth LED so each string of eight can be divided to use four LEDs instead of eight. Since the number of LEDs that are powered is adjustable, the dimming range is expanded.

Existing dimming control systems adjust the current (or voltage) provided to the LEDs, but continue to power all of the LEDs. For example, to reach a dimming level of 10%, an LED driver reduces the current provided to the LEDs so that the current is 10% of what is required for 100% output, i.e., no dimming. In FIG. 4, not only is the current (or voltage) provided to the LEDs by the driver adjusted, the number of LEDs powered is also adjusted. Table 1 illustrates an exemplary range of dimming that can be provided.

TABLE 1

| Output Level | No. LEDs | Lumens (lm) | Driver Output |
|---|---|---|---|
| 100% (no dimming) | 16 | 1000 | 24 V 350 mA |
| 50% | 16 | 500 | 24 V 175 mA |
| 50% | 8 (one string of 8) | 500 | 24 V 350 mA |
| 25% | 8 (one string of 8) | 250 | 24 V 175 mA |

TABLE 1-continued

| Output Level | No. LEDs | Lumens (lm) | Driver Output |
|---|---|---|---|
| 25% | 4 (one string of 4) | 250 | 12 V 350 mA |
| 12.5% | 16 | 125 | 24 V Approx. 50 mA |
| 12.5% | 8 (one string of 8) | 125 | 24 V 87.5 mA |
| 12.5% | 4 (one string of 4) | 125 | 12 V 175 mA |
| 6.25% | 4 (one string of 4) | 75 | 12 V Approx. 100 mA |
| 3.13% | 4 (one string of 4) | 50 | 12 V Approx. 75 mA |
| 2.70% | 4 (one string of 4) | <50 | 12 V Approx. 50 mA |

Note that the minimum dimming level for a system that powers all of the LEDs is 12.5%, as illustrated in the sixth row of Table 1. By controlling the number of LEDs that are powered, the dimming range is expanded to 2.70%.

The number of LEDs, position of the tap points, the type of switches, and the dimming levels shown in FIG. 4 and Table 1 are exemplary. As will be apparent to one skilled in the art, other LED configurations and dimming levels are also possible.

Exemplary Circuit for Sensing on-Board Temperature

Figure 5:
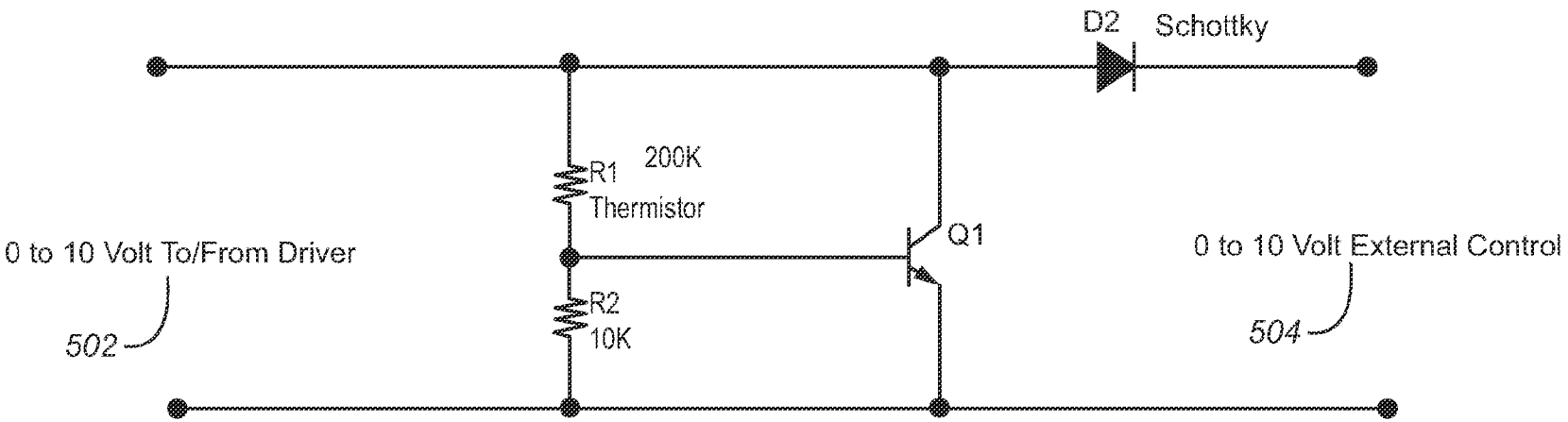
FIG. 5 is a circuit diagram illustrating an exemplary circuit that uses on-board intelligence to control a driver with a 0-10V control interface.

FIG. 5 illustrates an exemplary OBI controller for sensing temperature and controlling the driver based on both the control signal provided by the external controller and the temperature. The controller includes a circuit that is connected to the 0-10V control interface of the driver (0-10 Volt To/From Driver interface on the left-hand side of FIG. 5) 502 and to the 0-10V control signal provided by the external controller (0-10 Volt External Control interface on the right-hand side of FIG. 3) 504. The OBI circuit includes an NTC (negative temperature coefficient) thermistor R1 so the resistance of R1 decreases as the temperature increases. The OBI circuit also includes a second resistor R2, a switch Q1, and a diode D2.

Under normal conditions the value of R1 is sufficiently high so that there is essentially no current through R1 and R2 and the switch is open. Under these conditions the voltage on the 0-10V control interface to the driver corresponds to the voltage provided by the external controller. As the temperature increases, the resistance of R1 decreases and the switch Q1 closes. While the switch is closed resistor R2 decreases the voltage on the 0-10V control interface provided to the driver from the voltage provided by the controller.

Diode D2 is optional and is used to isolate the OBI circuit from other OBI circuits connected to the same external controller. By including the diode, any adjustments made to the 0-10V control interface of the driver by one OBI circuit are not propagated to other OBI circuits connected to the same external controller.

Although not shown in FIG. 5, the OBI circuit may optionally include another resistor (referred to herein as a pre-set resistor) connected across the switch Q1 and to the anode of the diode D2. The value of the optional resistor is used to better match the power output by the driver to the requirements of the LEDs on the LED board. For example, if the driver normally provides 700 mA, but the LEDs only require 350 mA, then the optional resistor can be used to adjust the output of the driver.

Other Exemplary Circuits for Sensing on-Board Temperature

Figure 6:
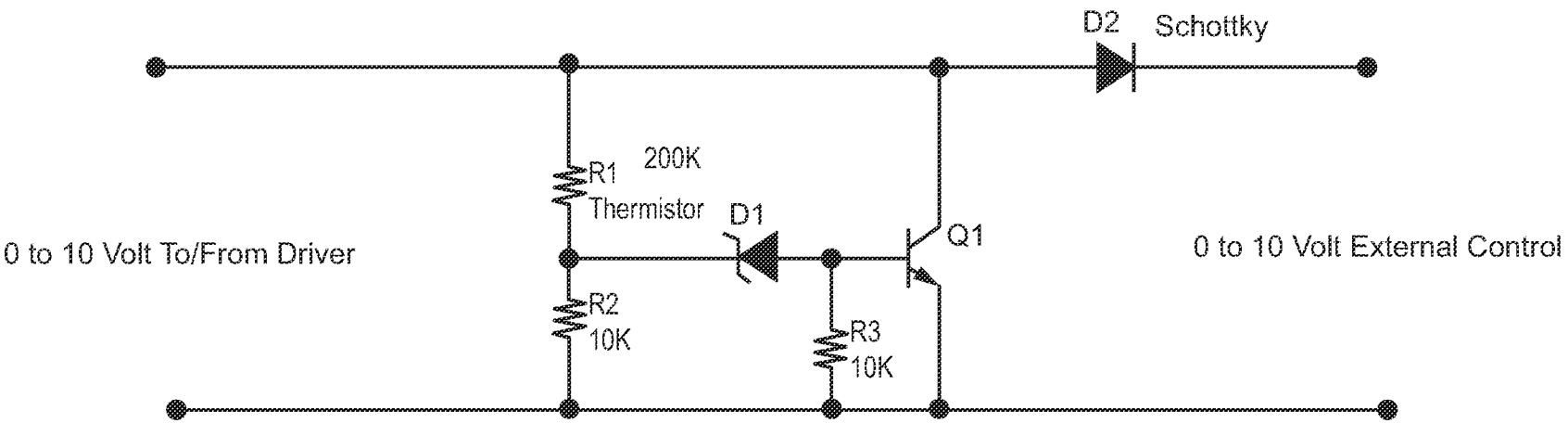
FIG. 6 is a circuit diagram illustrating another exemplary circuit that uses on-board intelligence to control a driver with a 0-10V control interface.

FIG. 6 illustrates another OBI circuit. The circuit of FIG. 6 is similar to the circuit of FIG. 5, but includes an additional diode D1 and an additional resistor R3. The additional diode and resistor are optional and are used to set a temperature threshold so that the OBI circuit only affects the 0-10V control interface of the driver when the temperature exceeds a threshold temperature. Similar to FIG. 5, FIG. 6 can also include a pre-set resister connected across the switch and to the anode of D2 (not shown), if appropriate.

Figure 7:
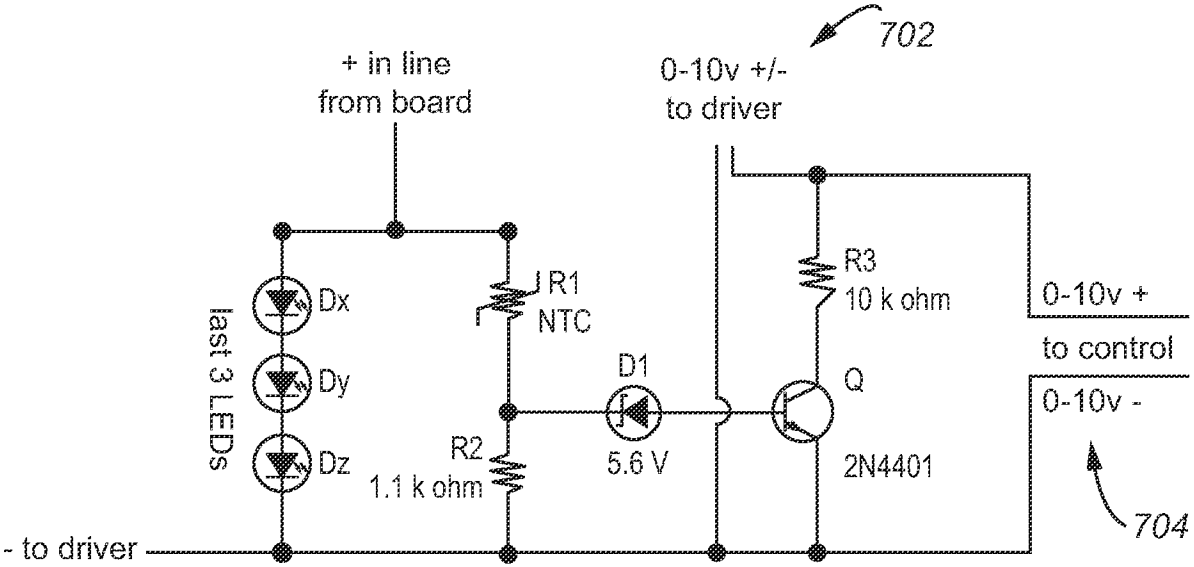
FIG. 7 is a circuit diagram illustrating another exemplary circuit that uses on-board intelligence to control a driver with a 0-10V control interface.

FIG. 7 illustrates another OBI circuit for sensing temperature. Similar to FIGS. 5 and 6, the circuit can modify the 0-10V control signal from an external controller 702 to control the output of the driver based on temperature.

The controller includes a circuit that is connected to the 0-10V control interface of the driver (0-10 Volt+/− to driver interface on the upper right-hand side of FIG. 7) 702 and to the 0-10V control signal provided by the external controller (0-10 Volt+ to control 0-10V− on the right-hand side of FIG. 7) 704. The OBI circuit includes an NTC (negative temperature coefficient) thermistor R1 so the resistance of R1 decreases as the temperature increases. The OBI circuit also includes a second resistor R2, a third resistor R3, a switch Q1, and a diode D1.

Under normal conditions the value of R1 is sufficiently high so that there is essentially no current through R1 and R2 and the switch is open. Under these conditions the voltage on the 0-10V control interface to the driver corresponds to the voltage provided by the external controller. As the temperature increases, the resistance of R1 decreases and the switch Q1 closes. While the switch is closed resistor R2 decreases the voltage on the 0-10V control interface provided to the driver from the voltage provided by the controller.

Tables 2 and 3 further illustrate the operation of the OBI circuit of FIG. 7. Table 2 illustrates the voltages across the last 3 LEDs (VLED (3)), the voltage across R2 (VR2), the voltage on the 0-10V interface (V(0-10)), the voltage across the switch Q (VCE), and the current to the LEDs (Current), as a function of the temperature of the LEDs, as sensed by R1 (Temp). Table 3 illustrates the current to the LEDs (Current) and the output level as set by the OBI controller (Percent), as a function of the sensed temperature of the LEDs (Temp).

Figure 8:
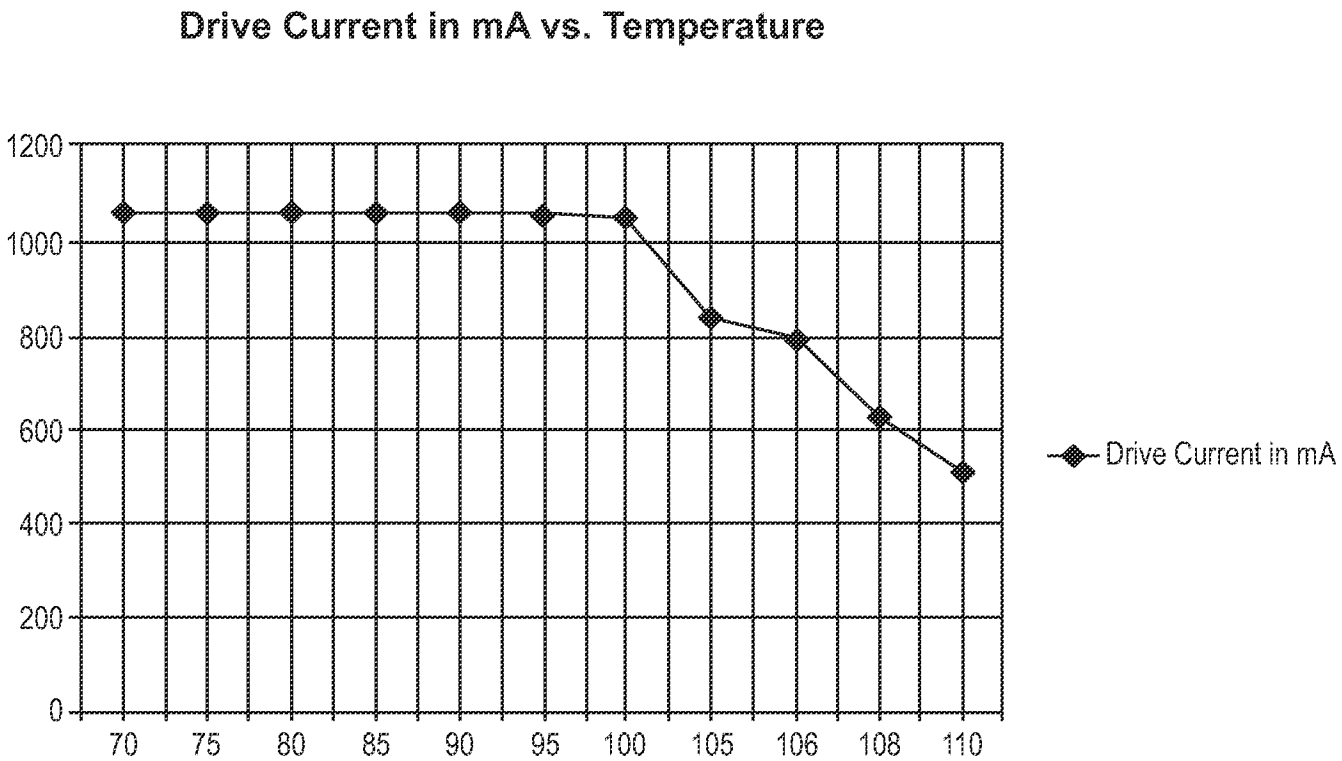
FIG. 8 is a graph illustrating the operation of FIG. 7, including an exemplary relationship between LED current and LED temperature

FIG. 8 graphically illustrates the information in Table 3 and shows that the current to the LEDs decreases as the temperature of the LEDs increases. FIG. 8 assumes that the dimming level indicated by the external controller or dimmer remains approximately constant. The OBI circuit reduces the LED current based on the sensed temperature.

TABLE 2

| VLED (3) | VR2 | V(0-10) | VCE | Current (mA) | Temp |
|---|---|---|---|---|---|
| 9.12 | 0.291 | 13.21 | 13.24 | 718 | 22.7 |
| 9.07 | 2.47 | 13.21 | 13.2 | 722 | 79 |
| 9.06 | 3.27 | 12.63 | 12.49 | 725 | 92 |
| 9.03 | 3.95 | 9.05 | 8.235 | 710 | 100 |
| 8.72 | 4.32 | 3.85 | 1.75 | 365 | 109 |
| 8.12 | 4.22 | 6.22 | 4.25 | 70 | 113 |
| 8.82 | 5.11 | 3.5 | 0.039 | 464 | 120 |
| 8.84 | 4.71 | 3.65 | 0.4025 | 492 | 115 |
| 9.21 | 4.32 | 6.49 | 4.35 | 830 | 105 |
| 9.21 | 4.19 | 7.62 | 5.79 | 950 | 104 |
| 9.26 | 4.04 | 7.84 | 6.85 | 1050 | 100 |

TABLE 3

| Temp | Current | Percent |
|---|---|---|
| 70 | 1059 | 100.857143 |
| 75 | 1059 | 100.857143 |
| 80 | 1059 | 100.857143 |

TABLE 3-continued

| Temp | Current | Percent |
|---|---|---|
| 85 | 1059 | 100.857143 |
| 90 | 1058 | 100.761905 |
| 95 | 1056 | 100.571429 |
| 100 | 1049 | 99.9047619 |
| 105 | 840 | 80 |
| 106 | 790 | 75.2380952 |
| 108 | 625 | 59.5238095 |
| 110 | 510 | 48.5714286 |

Although FIGS. 5-7 illustrate OBI circuits for sensing temperature, other OBI circuits can sense other board-level conditions and adjust the 0-10V control interface of the driver accordingly. Depending upon the condition, the OBI circuit may include additional and/or different components than those illustrated in FIGS. 5-7. For example, different types of sensors can be used to sense different conditions or a microprocessor or other type of processing device may be included in the OBI circuit. The OBI circuitry can also include other components to support other functions, including, but not limited to, the reconfiguration of the LEDs on the board.

The foregoing is provided for purposes of illustrating, describing, and explaining aspects of the present invention and is not intended to be exhaustive or to limit the invention to the precise forms disclosed. Further modifications and adaptation to these embodiments will be apparent to those skilled in the art and may be made without departing from the scope and spirit of the invention.

What is claimed is:

1. A system for controlling a plurality of LEDs, comprising:

a controller, wherein the controller receives a control signal from an external controller and receives a sensed condition signal from a sensor;

a driver having a 0-10V control interface, wherein the driver powers the LEDs at a level determined by the 0-10V control interface, and the driver and the controller are connected through the 0-10V control interface, wherein a voltage on the 0-10V control interface may vary between 0V and 10V;

the LEDs; and the sensor for sensing a condition associated with the LEDs and providing the sensed condition signal, wherein the controller adjusts a voltage of the 0-10V control interface based on the control signal and the sensed condition signal.

2. The system of claim 1, wherein the LEDs include a first LED string and a second LED string, further comprising:

a plurality of switches, wherein a first switch is connected to a first end of the first LED string and a second switch is connected to a first end of the second LED string, and a third switch is connected to a tap point of the first LED string and a fourth switch is connected to a tap point of the second LED string, wherein the controller controls the switches to configure the number of powered LEDs.

3. The system of claim 1, wherein the sensor senses a condition selected from the following: temperature, light output of the LEDs, ambient light, current, voltage, and operating time.

4. The system of claim 1, wherein the controller and the LEDs are located on a same circuit board.

5. The system of claim 1, further comprising a switch for disabling the controller, wherein the driver and the external controller are connected through the 0-10V control interface when the controller is disabled.

6. The system of claim 1, wherein a voltage of the control signal from the external controller may vary between 0V and 10V.

7. A method for controlling an output of an LED driver, wherein the LED driver powers a plurality of LEDs and has a 0-10V control interface, comprising:

receiving a control signal from an external controller, wherein a voltage of the control signal indicates a dimming level;

receiving a sensed condition signal that indicates a condition associated with operation of the LEDs; and based on the control signal and the sensed condition signal, adjusting a voltage of the 0-10V control interface of the LED driver, wherein the voltage of the 0-10V control interface may vary between 0V and 10V.

8. The method of claim 7, wherein the condition associated with operation of the LEDs is selected from the following: temperature, light output of the LEDs, ambient light, current, voltage, and operating time.

9. The method of claim 7, wherein the condition associated with operation of the LEDs is temperature, and wherein adjusting a voltage of the 0-10V control interface of the LED driver comprises decreasing the voltage of the 0-10V control interface if the temperature exceeds a threshold.

10. The method of claim 7, further comprising controlling at least one switch so that so that less than all of the LEDs are powered based on the control signal from the external controller.

11. A circuit for controlling a plurality of LEDs, comprising:

a first input line and a second input line, wherein the first and second input lines are capable of being connected to a 0-10V control interface of a dimmer;

a transistor connected between the first input line and the second input line, wherein a collector of the transistor is connected to the first input line and an emitter of the transistor is connected to the second input line;

a thermistor, wherein a first end of the thermistor is connected to the first input line and a second end of the thermistor is connected to a base of the transistor and a resistor; and the resistor, wherein a first end of the resistor is connected to the thermistor and the base of the transistor and a second end of the resistor is connected to the second input line, wherein the first input line and the second input line are capable of being connected to a 0-10V interface of a driver.

12. The circuit of claim 11, further comprising a diode inserted between the dimmer and the circuit, wherein the anode of the diode is connected to the thermistor and the collector of the transistor and the cathode of the diode is capable of being connected to the dimmer.

13. The circuit of claim 11, further comprising a pre-set resistor, wherein a first end of the pre-set resistor is connect to the first input line and a second end of the pre-set resistor is connected to the second input line.

* * * * *